United States Patent [19]

Ventura et al.

[11] Patent Number: 4,587,961

[45] Date of Patent: May 13, 1986

[54] ELECTROMECHANIC APPARATUS FOR CARRYING OUT PROGRAMMED PASSIVE GYMNASTICS

[75] Inventors: Angelo Ventura; Luciano Ventura, both of Torno, Italy

[73] Assignee: Ofmec Officine Meccaniche Mantovane S.p.A., Mantova, Italy

[21] Appl. No.: 579,798

[22] Filed: Feb. 16, 1984

Related U.S. Application Data

[63] Continuation-in-part of Ser. No. 382,140, May 26, 1982, abandoned.

[30] Foreign Application Priority Data

Jun. 4, 1981 [IT] Italy ..... 22137 A/81

[51] Int. Cl.[4] ..... A61H 1/02

[52] U.S. Cl. ..... 128/25 R; 128/33

[58] Field of Search ..... 128/25, 33, 24 R, 25 B, 128/70; 272/144

[56] References Cited

U.S. PATENT DOCUMENTS

| | | | |
|---|---|---|---|
| 2,130,922 | 9/1938 | Hawley | 128/25 R |
| 2,227,526 | 1/1941 | Wilson | 128/25 R |
| 2,548,408 | 4/1951 | Tammen | 128/25 R |
| 2,681,650 | 6/1954 | Goss | 128/33 |
| 2,949,911 | 8/1960 | Kennard et al. | 128/25 R |
| 3,060,926 | 10/1962 | May | 128/25 R |
| 3,450,132 | 6/1969 | Ragon et al. | 128/25 R |
| 3,661,149 | 5/1972 | Ferries | 128/25 R |
| 3,712,613 | 1/1973 | Feather et al. | 128/25 R X |
| 3,735,979 | 5/1973 | Levenberg | 272/144 |
| 3,767,195 | 10/1973 | Dimick | 272/73 |
| 3,824,994 | 7/1974 | Soderberg, Sr. | 128/25 R |
| 3,973,251 | 8/1976 | Stephas | 272/73 X |
| 4,215,680 | 8/1980 | Okuda | 128/25 R X |
| 4,344,422 | 8/1982 | Immel | 128/33 |

FOREIGN PATENT DOCUMENTS

| | | | |
|---|---|---|---|
| 1075797 | 2/1960 | Fed. Rep. of Germany | 128/25 R |

*Primary Examiner*—Richard J. Apley
*Assistant Examiner*—Robert W. Bahr
*Attorney, Agent, or Firm*—Bucknam and Archer

[57] ABSTRACT

An articulated bed is formed by articulated orientable sections and provided with adjustable devices for fixing the patient's legs thereto and causing the patient's feet to rest thereon. A linkage independently moves the patient's legs either in an extended condition or in a retracted condition. A linkage moves the patient's arms in a supine condition. The bed and the sections thereof are driven via rod-crank-cam assemblies.

9 Claims, 3 Drawing Figures

ELECTROMECHANIC APPARATUS FOR CARRYING OUT PROGRAMMED PASSIVE GYMNASTICS

This is a continuation-in-part of application Ser. No. 382,140, filed May 26, 1982, now abandoned.

BACKGROUND OF THE INVENTION

The present invention generally relates to gymnastics practicing apparatus and, more specifically, to a passive gymnastics apparatus which can be programmed according to predetermined operative sequences.

As is well known, for re-educating limbs or other parts of the human body after substantially irreversible lesions there are presently used apparatus effective to move the damaged parts according to movement patterns capable of recovering, at least partially, the functionality of said limbs or parts.

The known recovering apparatus generally are effective to re-educate individual damaged parts and therefor each particular apparatus acts on a predetermined individual part or limb of the human body.

SUMMARY OF THE INVENTION

The task of the present invention is to provide an apparatus for the passive gymnastics which is effective to allow for several damaged parts to be optimally re-educated, either individually or jointly.

The principal object of the present invention is to provide a passive gymnastics apparatus which is effective to permit passive gymnastics to be carried out in a programmable way by an operator, thereby facilitating the re-education work of the latter.

The thereinabove mentioned task and objects of the present invention, as well as yet other objects which will become more apparent hereinafter, are achieved by a passive gymnastics apparatus, according to the invention, characterized in that it comprises an articulated bed formed by orientable articulated sections and provided with adjustable means for fixing thereto the patient's legs and causing said patient's feet to rest thereon, as well as with linkage for independently moving the patient legs either in an extended condition or in a retracted condition, a linkage for moving the patient's arms in a supine condition, driving means which, by rod-crank-cam assemblies, are effective to drive said bed and the sections thereof, and a linkage for moving said patient's legs and arms.

Advantageously, the linkage for moving the patient's legs and arms are provided with means for varying, depending on the needs, the amplitude and speed of said leg and arm movements.

BRIEF DESCRIPTION OF THE DRAWINGS

The invention will be described in a more detailed way thereinafter, with reference to a presently preferred illustrative and not limitative embodiment thereof, which is illustrated in the accompanying drawings, wherein.

DETAILED DESCRIPTION OF PREFERRED EMBODIMENTS

Figure 1:
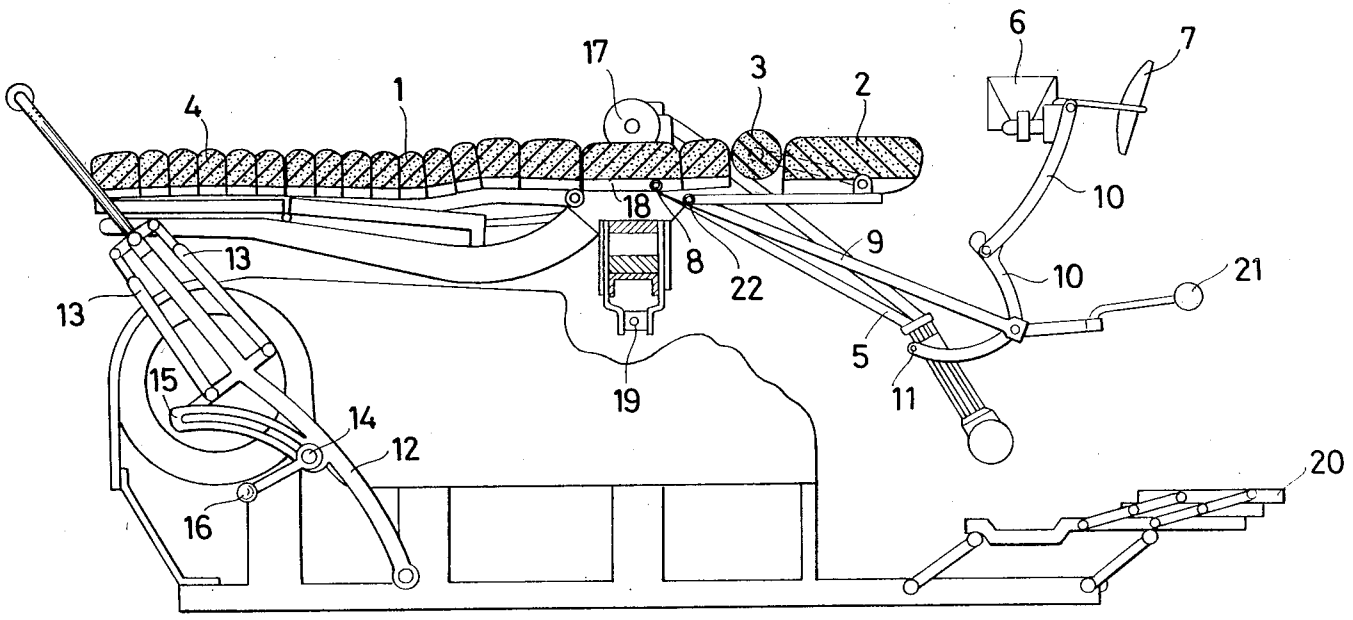
FIG. 1 is a frontal view partly in section, of the apparatus of the invention.
Figure 2:
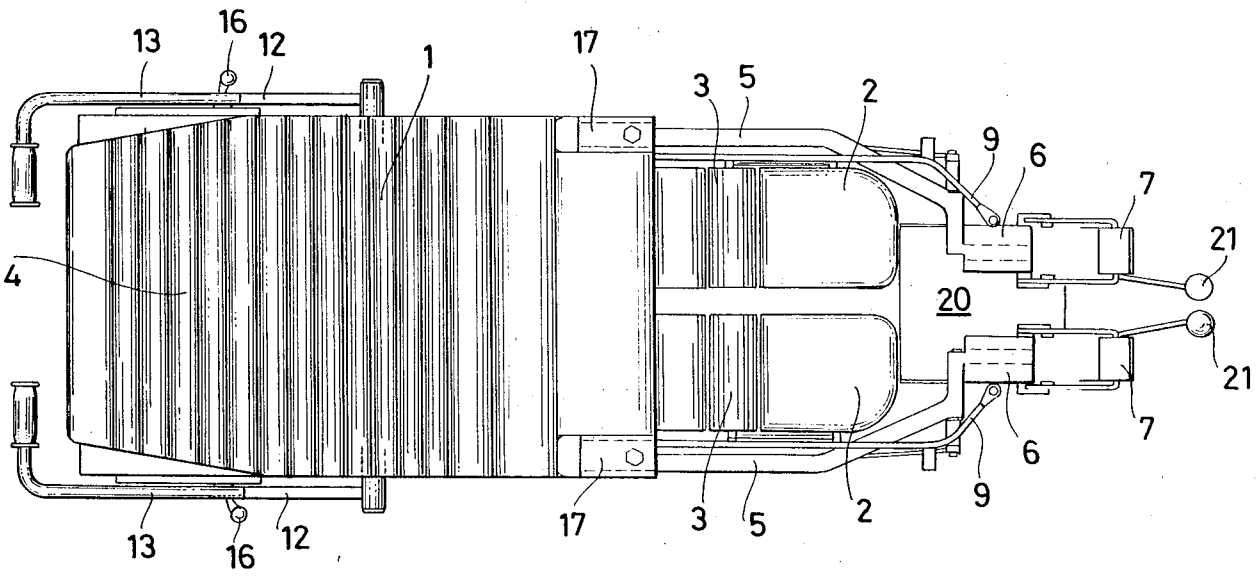
FIG. 2 is a top view of the apparatus of the invention.
Figure 3:
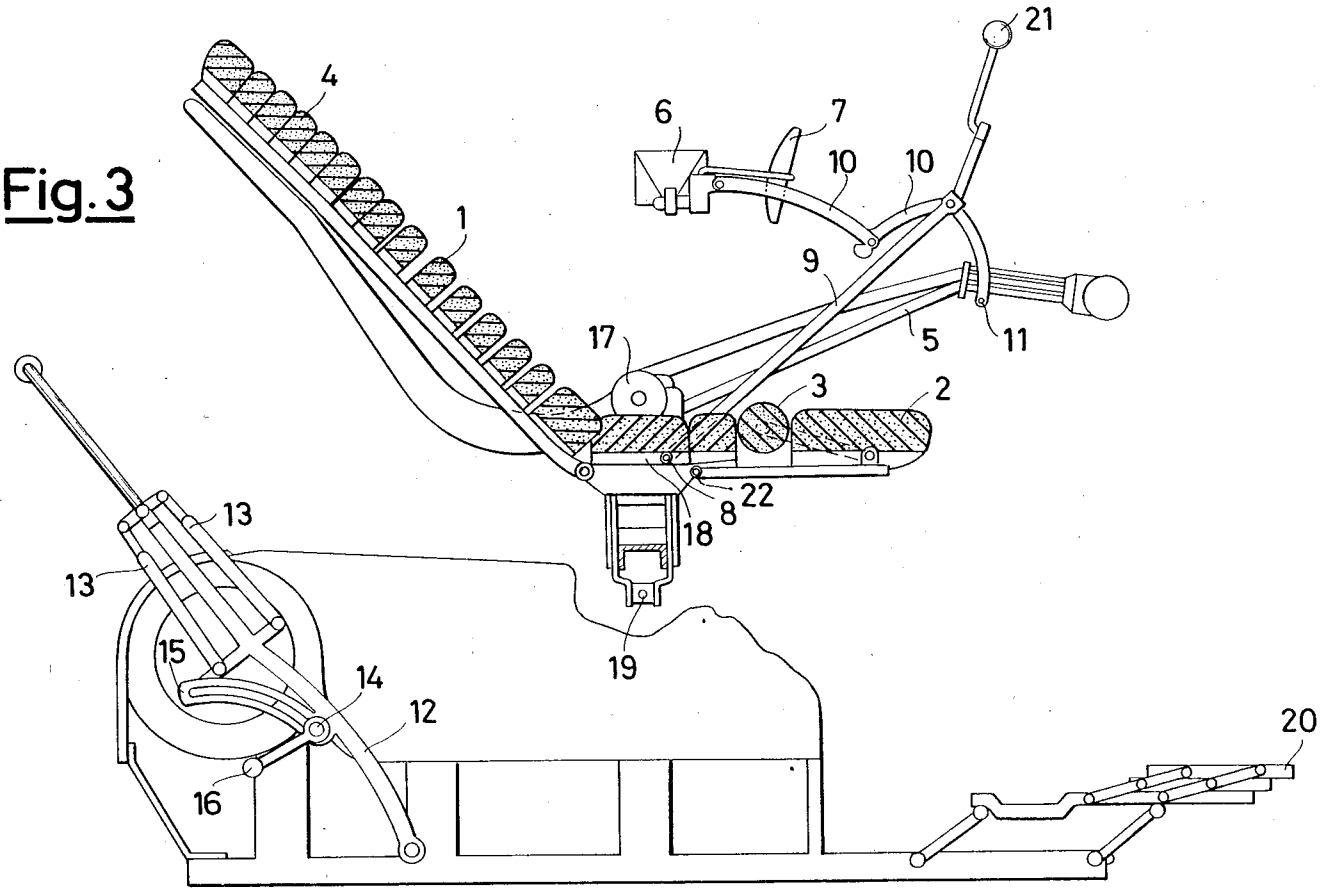
FIG. 3 is a frontal view, partly in section, of the apparatus showing its position for back and leg bending.

More specifically, the electromechanic apparatus for carrying out passive and re-education gymnastics according to the invention comprises, as shown in FIGS. 1 and 3, an articulated back rest 1 for extending, bending and laterally moving the rachides (spinal column). The articulated bed can assume static positions or through motor-driven linkages can continuously exercise parts of a patient's body during leg movements. The thigh-rest is housed in a carrying structure suitable hinged to point 22 and is moved by linkages suitably connected, when necessary, to the legs movement. The structure houses a cylindrical cushion 3 which can rotate about a pivot and take a desired position on the plane.

The bed extends as far as the patient knees by means of two movable sectors or sections 2, which are independent from one another and support the thighs. The bed is also provided with a cylindrical cushion 3 for raising the patient's knee at the starting of the leg bending movement. The cushion 3 is employed to support the knee when a contemporary rotation and bending movement of the leg is desired. The bed also has a movable orientable sector or section 4 for the patient head. The head rest 4 is connected to the back rest through levers and articulated joints. The head rest 4 can be moved to positions up to 15 degrees below and thirty degrees above the plane of the bed. The angles which the head rest can take allow the patient's head to be placed in the optimum position for each exercise.

FIG. 3 shows another position which parts 1 to 4 of the apparatus can take. To the carrying structure of the bed are articulated, by means of suitable mechanical devices, means fit for the gymnastic moving of arms and legs. The system, by linkages and cams, receives the motions from electrical motors; the motors with the moving linkages are housed inside the carrying structure of the bed.

The apparatus also comprises two articulated levers 5 provided with a band articulated supporting member 6 for the patient's legs and with a foot-rest 7. These levers are effective to allow the angled extension movements of the patient's extended legs and the alternative forward and rearward movements thereof, in a bent condition, with the possibility of carrying out a different movement of the individual legs and, if desired, with a leg (either the left or the right one) in a rest condition (mobility of the coxofemoral articulation and of the knee).

In order to pass from an angular movement of the extended legs to a leg-thigh flexure or bending movement, a rotating supporting member is provided, which coaxially extends with respect to the lever 5 and independently therefrom; on said rotating supporting member there is pivoted at 8 a tie rod 9, displaced with respect to the axis of said rotating supporting member, which tie rod 9, being suitably locked by an electromagnet operated device, causes the lever portion 10 bearing said band articulated supporting member 6 and foot-rest 7 to rotate about the pivot pin 11 in such a way as to carry out a parabolic retractile movement effective to push the patient's leg-thigh against the abdomen. Thus, mobility is afforded to the coxo-femoral articulations and knees, at a supine position, and knee mobility at a prone condition.

The apparatus also has two articulated rocker levers 12 provided with biassing springs 13. These levers permit the patient's arms to be raised and lowered with a slight drawing, in the supine condition (mobility of the shoulders and elbows).

Suitably pivoted levers 12 rotate within an arc of 130°, the movement being obtained through an electrical motor by means of motion drives. The movement amplitude or range of the levers 12 can be adjusted by means of a slider member 14, which forms the pivot pin of the respective connecting rod and is displaced in a graduated sector 15 which latter is locked at the desired position by means of a handle 16. The system allows the simultaneous moving of the two levers 12, both moving the two arms simultaneous or one thereof after the other. If necessary, one of the levers can be kept locked if needed. Movement of the levers 12 is not allowed by the safety system when the plane of the bed is changing.

In FIG. 1, the abduction (parting) and adduction (approaching) movements of the legs in a supine position are carried out manually, and the amplitude thereof is adjusted by means of suitable set screws as provided on, said articulated levers 5, by means of the handles 21.

An assembly or apparatus for the cervical drawing, effective to be applied on the bed is also provided.

In order to adjust in position the coxo-femoral articulations with respect to the movement principal axis 17, the central bed portion 18, where the glutaei of the patient are located, is mounted on a parallel double-screw articulation (left and right)19 effective to be operated by a crank. In order to facilitate access to the articulated bed, the apparatus is provided with a collapsible ladder 20 effective to be retracted as the patient is on the bed in order to allow for the lever to be operated.

All of the mentioned elements are provided with devices for adjusting the amplitude of movement to fit patients of different heights; from a minimum of 150 cm to a maximum of 190 cm.

The controls for controlling the height adjusting devices are located on the same apparatus, whereas the controls for adjusting the movement amplitude, as well as said movement speed and duration, are located on a controlling console, provided separately from the apparatus.

A plurality of relays are also provided on the console. The relays are energized depending on the exercise which is required, by means of contacts associated with the mechanical components.

If said components are not in their proper positions, then the timer is not supplied with current, thereby the control switch of the main motor is not operated and the motor will be in a rest condition. This embodiment is effective to prevent the operator from erroneously operating the apparatus.

It should be noted that in addition to the back, leg and arm movements, carried out by the apparatus depending on the desired program and with the patient in a supine condition, the operator or therapist may also carry out manipulations on the patient's arms, wrists and hands, legs, ankles and feet, in addition to the neck and shoulders.

In particular it should also be noted that the patient's neck is also subjected to a slight drawing, which can also be adjusted upwardly or downwardly with respect to the horizontal direction.

Moreover, the subject apparatus is also capable of assuring that all of the movements are repeated with the same direction and amplitude, at a constant speed and in a precise and smooth way, thereby eliminating any possibilities of errors with respect to the preset program.

In summary, the provided movements consist, in particular, or the spontaneous ones such as walking, bending down, sitting down, going up and downstairs, moving the arms and so on. These movements are carried out with a variable speed, which is low at the start and progressively increases in the intermediate stage and progressively decreases during the end stage.

More specifically, those movements are obtained by several combinations of levers or linkages, as controlled by suitably contoured sectors.

The amplitude of the back-leg movements is adjusted by means of low voltage electric motors which are associated to articulated or rotating gears remotely controlled by means of suitable electrical devices as provided on a console.

The amplitude of the patient's arm movements is manually adjusted by means of a slider member effective to slide along a guide as suitably graduated, and to lock at the desired position. This adjusting is an independent one for each individual arm.

The controlling electrical apparatus consists of a plurality of relays suitably grouped for each individual exercise and energized through related microswitches located on the several mechanical elements of the apparatus carrying out the mentioned movements.

Thus, the operator is prevented from carrying out erroneous operations if the program does not correspond to the exercise to be carried out.

The possibility is also afforded of setting the position of the bed back, depending on the needs of the patient, by means of a suitable motor operated gear.

In addition to the foregoing, a possibility is also afforded of exercising one single limb, either an upper or a lower one, by holding the other in a horizontal position.

Moreover, it is also possible to change the amplitude of the movements of the individual limbs (the left or right ones), by means of that same exercise.

The advantages of the apparatus of the present invention will be readily apparent from the foregoing disclosure.

In fact, in addition to facilitating the work of the operator or therapist, since the latter is released from the heavy work associated with the large movements; the apparatus is also effective to facilitate the physiotherapic function owing to the precision and smoothness of the exercise it is capable of carrying out.

Obviously, the means for driving the several gears associated with the instant apparatus may be of any suitable type, i.e., of the electric, pneumatic or oleodynamic type, without departing from the scope of the present invention.

We claim:

1. A passive gymnastics programmed apparatus, comprising an articulated bed formed by articulated orientable sections;

adjustable means mounted on said bed for releasably affixing a user's legs thereto and permitting the user's feet to rest thereon;

linkage means coupled to said adjustable means for selectively independently moving the legs of said user in a selected one of an extended condition and a retracted condition, said linkage means selectively moving the right leg of said user, the left leg of said user and both legs of said user independently, selectively rotating and bending both legs of said user, the right leg of said user and the left leg of said user, selectively flexing the back of said user, selectively bending the back of said user and the left leg of said user, the back and the right leg of said user and the back and both legs of said user, selectively flexing the back and legs of said user, selectively bending the back and right leg of said user, the back and left leg of said user and the back and both legs of said user, and selectively abducting and adducting the legs of said user;

a cylindrical member pivotally mounted on said bed independently of said linkage means and positionable relative to the plane of said bed for raising the knees of said user and supporting said knees only at the commencement of bending movement of said legs;

additional linkage means for selectively independently moving the arms of said user in a supine position;

driving means including rod-crank-cam assemblies for moving said bed and said orientable sections thereof via said rod-crank-cam assemblies; and set screws and handles coupled to said linkage means for manually selectively providing abduction and adduction movements of the legs of said user in a supine position and adjusting the amplitude of said movements.

2. Apparatus as claimed in claim 1, wherein said linkage means and said additional linkage means include means for varying the amplitude and speed of movement.

3. Apparatus as claimed in claim 1, wherein all movements are performable in a supine position.

4. Apparatus as claimed in claim 1, further comprising a base structure supporting said bed and a collapsible ladder mounted on said base structure for providing access to said bed.

5. Apparatus as claimed in claim 1, further comprising means for selectively manually adjusting the amplitude of the arm movements of said user, said means comprising a graduated guide for each arm of said user, a slide member slidably movable in said guide and lock means for manually locking said slide member in a desired position.

6. Apparatus as claimed in claim 1, wherein said driving means is pneumatic.

7. Apparatus as claimed in claim 1, wherein said driving means is oleodynamic.

8. Apparatus as claimed in claim 1, wherein said driving means is electrical.

9. Apparatus as claimed in claim 8, wherein said driving means further includes a plurality of microswitches located on selected components of said apparatus and a plurality of relays located for selected exercise programs in operative proximity with said microswitches and energizable via corresponding ones of said microswitches.

* * * * *